US005362104A

United States Patent [19]

Rapp et al.

[11] Patent Number: 5,362,104

[45] Date of Patent: Nov. 8, 1994

[54] NON-SCORED BALLOT CARD

[75] Inventors: Tod A. Rapp, 129 Park Dr., Xenia, Ohio 45385; John W. Donahue, Dayton, Ohio

[73] Assignee: Tod A. Rapp, Xenia, Ohio

[21] Appl. No.: 106,381

[22] Filed: Aug. 13, 1993

Related U.S. Application Data

[63] Continuation-in-part of Ser. No. 896,809, Jun. 9, 1992, Pat. No. 5,260,550, which is a continuation of Ser. No. 557,269, Jul. 24, 1990, abandoned.

[51] Int. Cl.[5] ..... B42D 15/00

[52] U.S. Cl. ..... 283/5

[58] Field of Search ..... 283/5; 281/2, 5; 235/50, 52; 434/306

[56] References Cited

U.S. PATENT DOCUMENTS

| | | | |
|---|---|---|---|
| 1,404,611 | 1/1922 | Hong | 283/5 |
| 2,923,452 | 2/1960 | Holovka, Jr. | 225/93 |
| 3,240,409 | 3/1966 | Harris | 225/93 |
| 3,460,854 | 8/1969 | Koelling | 283/5 |
| 3,536,257 | 10/1970 | Laus | 235/50 |
| 4,297,566 | 10/1981 | Ahmann | 235/50 R |
| 4,488,034 | 12/1984 | Stephens et al. | 235/50 A |
| 4,807,908 | 2/1989 | Gerbel | 283/5 |
| 5,206,486 | 4/1993 | Stephens et al. | 235/51 |

*Primary Examiner*—Willmon Fridie

*Attorney, Agent, or Firm*—Biebel & French

[57] ABSTRACT

A non-scored ballot card having a detachable portion provided with a triangular opening for locking the ballot card in a voting position in a vote recorder. The triangular opening is configured for cooperation with a barricade having a generally triangular cross-section.

6 Claims, 5 Drawing Sheets

NON-SCORED BALLOT CARD

CROSS-REFERENCE TO RELATED APPLICATIONS

This application is a Continuation-In-Part of U.S. patent application Ser. No. 07/896,809 filed Jun. 9, 1992, now U.S. Pat. No. 5,260,550 which is a Continuation of U.S. patent application Ser. No. 07/557,269 filed Jul. 24, 1990, now abandoned.

BACKGROUND OF THE INVENTION

This invention relates to an improved machine-readable non-scored ballot card.

It is well known to provide pre-scored ballot cards for use in conducting an election. Such ballot cards are inserted into a vote recorder and punched by an appropriate stylus to record voting choices. The perforated scores in such ballot cards facilitate hand punching by the voters. Typical examples of such prior art are disclosed in Harris U.S. Pat. No. 3,240,409, Laws U.S. Pat. No. 3,536,257 and Ahmann U.S. Pat. No. 4,297,566. While vote recorders of that particular type are relatively easy to operate, they have a disadvantage in that non-separated "chad" sometimes hangs from the edges of the punched openings. This causes tally errors during the vote tabulation process.

One way of avoiding the chad problem is to use non-scored ballot cards in a vote recorder holder such as a vote recorder of the type described in Stephens et al. U.S. Pat. No. 4,488,034. Such a vote recorder may have a housing, a base member mounted to the housing, a resilient mat member mounted to the base member, a lower anvil mounted to the base member adjacent the mat member, an intermediate template member spaced apart from and fixedly mounted to the base member and a slidably mounted upper mask member. The template member has a pattern of guide channels or openings which are in registration with a similar pattern of punch openings in the anvil member. Each punch opening in turn is in registration with a corresponding pair of criss-crossed slits in the mat member. Also, the mask member is provided with a pattern of openings which match the patterns of openings in the template member and the anvil member. However the openings in the mask member are normally out of registration with the other sets of openings, so the mask member normally blocks access to the punch plate. When a ballot card is inserted into the apparatus, the upper mask member is moved from its normal position into an operating position wherein its openings are in registration with the openings in the other members. The ballot card is provided with a pair of registration apertures which are fitted over a pair of card registration pins to lock the card in its fully inserted position. This enables a punch to be inserted through the mask plate, along a guide channel and into working relationship with a punch opening. A voting choice is recorded in the ballot card by forcing the punch against the card and through the underlying punch opening. As a consequence of this action the punch and the anvil cooperatively shear out a chip from the ballot card. The slits in the rubber mat act as finger extensions to grab the severed chip.

Another prior art vote recorder omits the rubber mat and uses a punch having a telescopic sleeve surrounding the punch tip. Again the ballot card is unscored, and an upper template (or mask plate), an intermediate guide plate and a punch plate are provided. In this device the sleeve forces the ballot card against the surface of the punch plate while the punch tip cooperates with the sharp edge around an adjacent punch plate opening to shear out the chip. The mask plate is fixed, while the guide plate is moved into a registration position during insertion of the ballot card. The openings in the mask plate and guide plate are sufficiently large to permit passage of the punch sleeve.

While the above-described vote recorders of the non-scored ballot type eliminate the hanging chad problem, they introduce another difficulty of a somewhat different type. During the tally process one edge of the ballot card (the edge at that end of the ballot card which is remote from the registration apertures) is positioned against a registration surface in the ballot reader. While the ballot card is in that position radiation (usually infrared radiation) is transmitted through the punched holes for sensing by accurately positioned radiation sensors. In order for the sensors to receive the radiation and correctly record the vote, the punched holes must be accurately positioned relative to the end of the ballot card. In contrast to pre-scored ballot cards the punched holes in non-scored ballot cards may be located at any position permitted by tolerance errors within the vote recorder. Those errors are critically dependent upon the distance between the registration pins and the openings in the punch plate. Also the distance between the registration edge of the ballot card and the region to be punched is likewise critical. This latter distance depends upon the positioning of the registration apertures relative to the registration edge of the ballot. Thus it is necessary to provide ballot cards having precisely positioned registration apertures in order to assure the required punching accuracy. This increases the cost of the ballot cards as well as the cost of the vote recorder. Moreover, even if registration pins and registration apertures are positioned with a fair degree of accuracy, an out-of-tolerance condition may be caused by flexing and compression of the ballot card.

SUMMARY OF THE INVENTION

The present invention provides a non-scored ballot card for use with an improved punch-type vote recorder. The vote recorder has a slidably mounted punch plate which moves in fixed relation to a sliding guide plate. A non-scored ballot card is inserted into the vote recorder and moves the guide plate and punch plate into registration with a stationary mask plate. A bias spring at the foot of the vote recorder resists forward movement of the guide plate and the punch plate. When the guide plate and the punch plate are in registration with the mask plate, a retractable barricade having a generally triangular cross-section moves downwardly into a triangular opening in the ballot card. This locks the ballot card into a voting position. In this position the mask plate, guide plate and punch plate are in alignment for reception of a hand-held stylus. The stylus is operated by a voter to indicate voting preferences.

The ballot card of this invention is non-scored and is specially configured with a triangular opening for reception of the retractable barricade. When the barricade is in position it engages the punch plate thereby resisting the action of the bias spring and reducing compressive forces in the ballot card, Thus improved punching accuracy may be achieved.

Accordingly, it is an object of this invention to provide a machine-readable, non-scored ballot card for use with an improved punch-type vote recorder.

Another of this invention is to enable accurate punching of non-scored ballot cards.

Yet another object of the invention is to reduce the compression force on a ballot card for reduction of punching errors.

Other objects and advantages of the invention will be apparent from the following description, the accompanying drawings, and the appended claims.

DESCRIPTION OF THE PREFERRED EMBODIMENT

Figure 1:
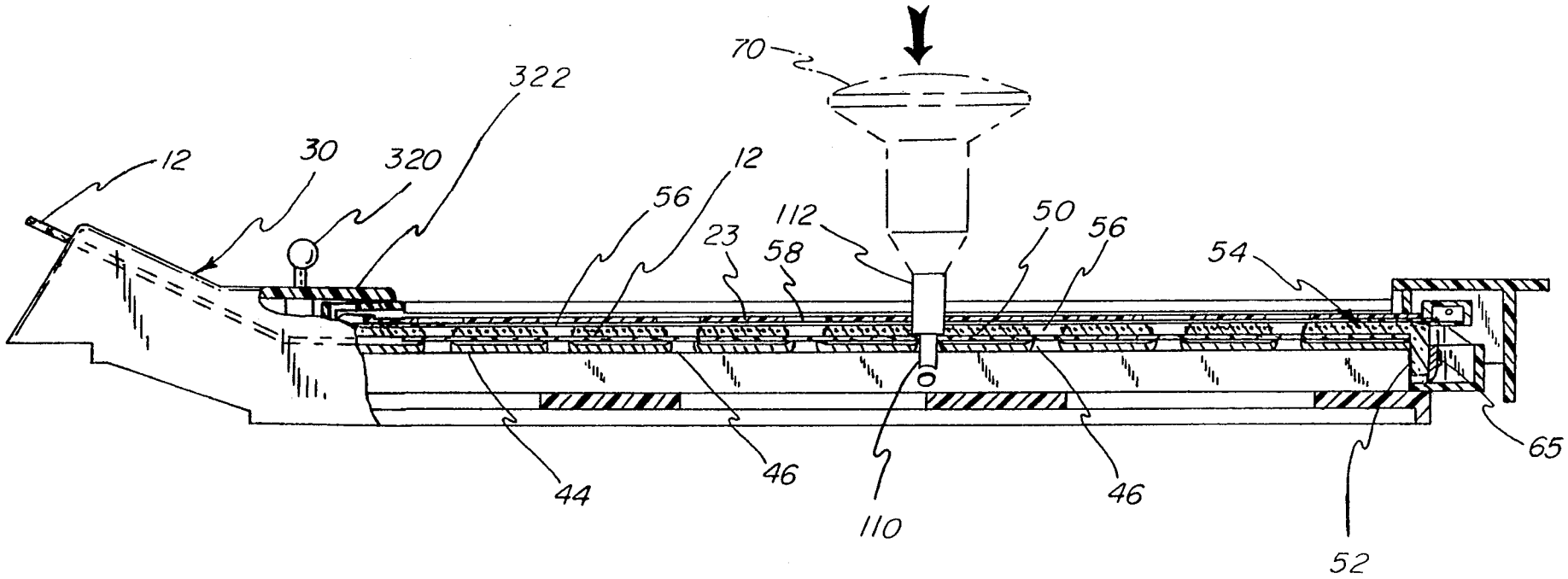
FIG. 1 is a cross-sectional view of a vote recorder showing punching stylus, in phantom.
Figure 2:
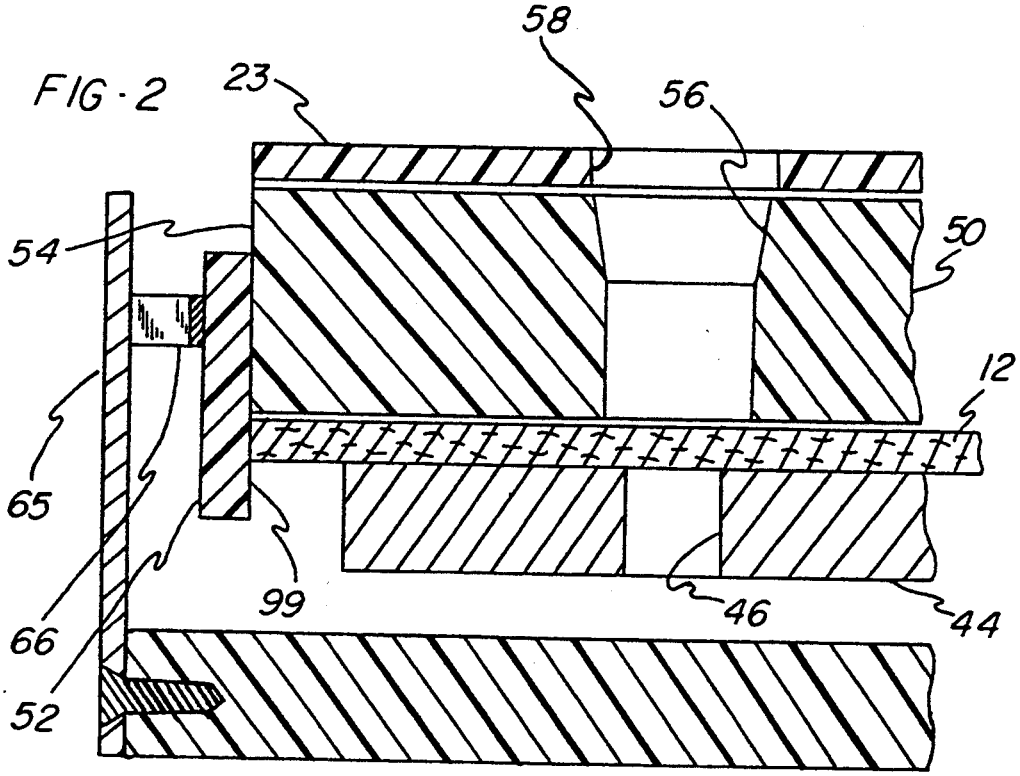
FIG. 2 is an enlarged illustration of a ballot card being registered against a card block.
Figure 3:
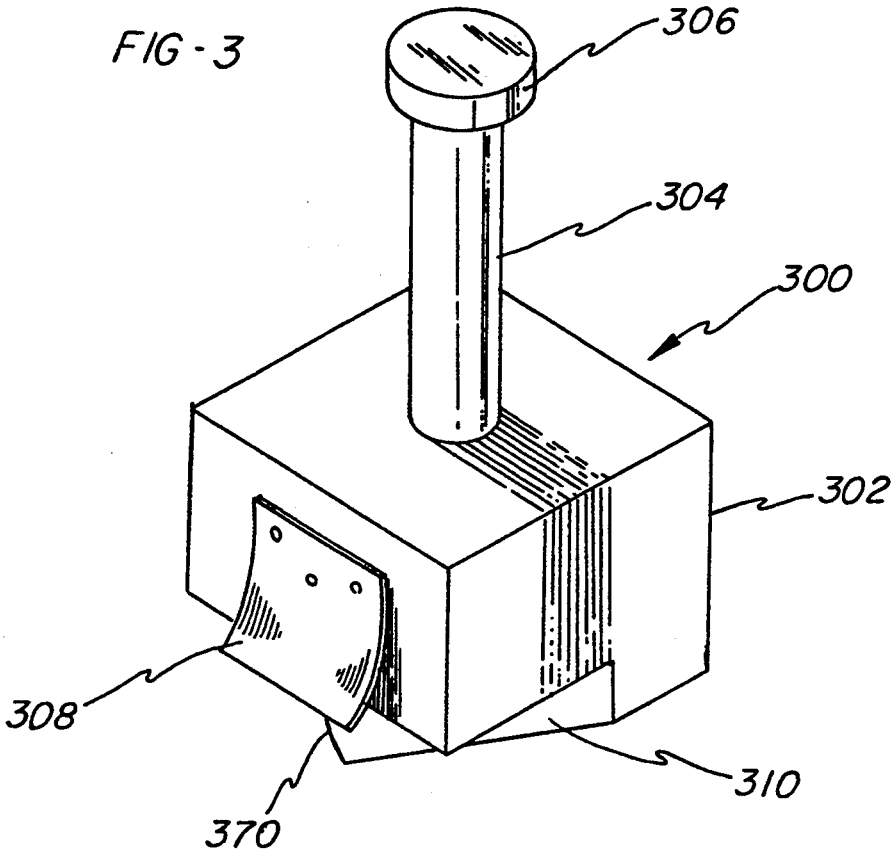
FIG. 3 is an illustration of a barricade for use with the ballot this invention.
Figure 4:
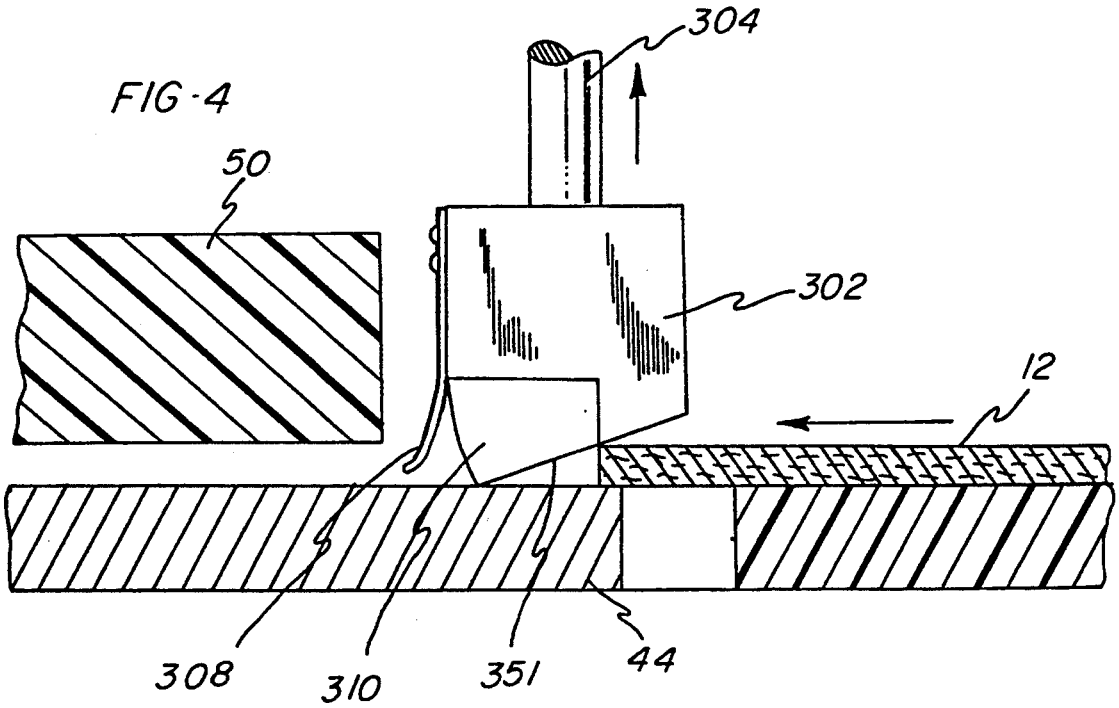
FIGS. 4 and 5 are schematic illustrations of successive positions of the barricade of FIG. 3 during insertion of the ballot card into the vote recorder.

Referring to FIGS. 1 and 2, a punch-type vote recorder 10 for recording votes on a non-scored ballot card 12, supports a series of ballot pages (not illustrated) and has a mask plate 23, provided with a series of access openings 58. Mask plate 23 rests on top of a guide plate 50. Vote recorder 10 has a head 30 which is provided with a longitudinally directed slot for receiving ballot card 12. Ballot card 12 is non-scored, and is provided with a triangular opening for cooperation with a barricade 30 as hereinafter described with reference to FIGS. 3–7.

Guide plate 50 has a series of guide passages 56 in alignment with access openings 58. A punch plate 44 having a plurality of die openings 46 therein, is secured to guide plate 50 in such a manner as to put die openings 46 in alignment with guide passages 56. Guide plate 50 and punch plate 44 are slidably mounted in ballot holder 10 and are relatively positioned so as to define a ballot card passage therebetween of sufficient size to permit the easy insertion of ballot card 12. The height of the ballot card passage is minimized so as to improve the alignment of die openings 46 and guide passages 56. Preferably this height is about 2 to 3 times the thickness of ballot card 12. Thus for an election using 0.007 inch thick ballot cards, vote recorder 10 may have a ballot card passage which is 0.014 to 0.021 inch high.

Guide plate 50 has a downwardly extending flange or card block 52 rigidly secured to its distal face 54 for registration of ballot card 12 when in the "voting" position. The position of card block 52 is at all times fixed relative to punch plate 44. Furthermore, card block 52 defines an end wall for the ballot card passage and is provided with an inwardly facing registration surface 99. The positioning of registration surface 99 relative to die openings 46 corresponds to the positioning of a ballot reader registration surface (not illustrated) relative to its associated ballot-reading photocells. This minimizes reading errors during the tally process. A leaf spring 66 is mounted upon the outer face of card block 52 for biasing card block 52 against the foot of the ballot card.

As ballot card 12 is inserted into vote recorder 10, it enters the ballot card passage, and eventually engages registration surface 99 of card block 52. At this point continuing insertion pressure upon the ballot card moves guide plate 50 and punch plate 44 forwardly, forcing leaf spring 66 to compress against an abutment plate 65 secured fast within vote recorder 10. This in turn produces a temporary reaction force against the foot of ballot card 12. The card is locked in position by an arrangement which relieves it of most of this reaction force.

In operation the user, after properly inserting the ballot card 12 into vote recorder 10 and locking the card 12 in its fully inserted position, inserts the end of the stylus 70 downwardly through the openings 58 and 56 in the mask plate 23 and the punch guide 50, respectively, to record his vote. Stylus 70 is provided with a telescopic sleeve 112 surrounding a punch shaft 110. The access openings 58 in mask plate 23 are slightly larger than guide passages 56. This feature is designed to facilitate the entry of the telescopic sleeve 112 into guide plate 50 (FIG. 6).

Figure 7:
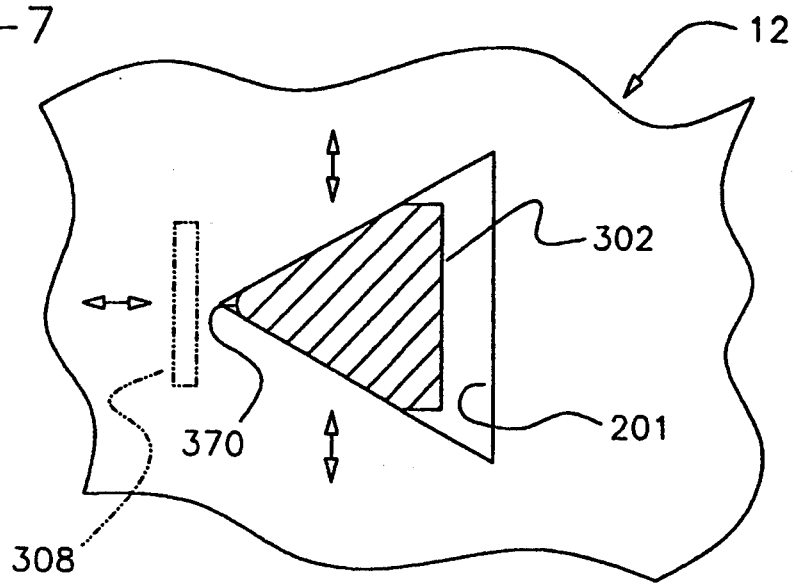
FIG. 7 is an enlarged illustration of a ballot card opening.

The card locking mechanism comprises a moveable barricade 300 provided with a block 302, a support rod 304 and a flange 306. A flexible skirt 308 is secured to the front face of block 302. Preferably skirt 308 is made from a piece of spring steel having a slight permanent curvature. The lower surface of skirt 308 is coated by a high friction material, such as vulcanized rubber. Block 302 has a slightly curved leading edge 370 and a waist region 310 which angles rearwardly from the edge 370 to define a pentagonal cross-section as best illustrated in FIG. 7.

Figure 6:
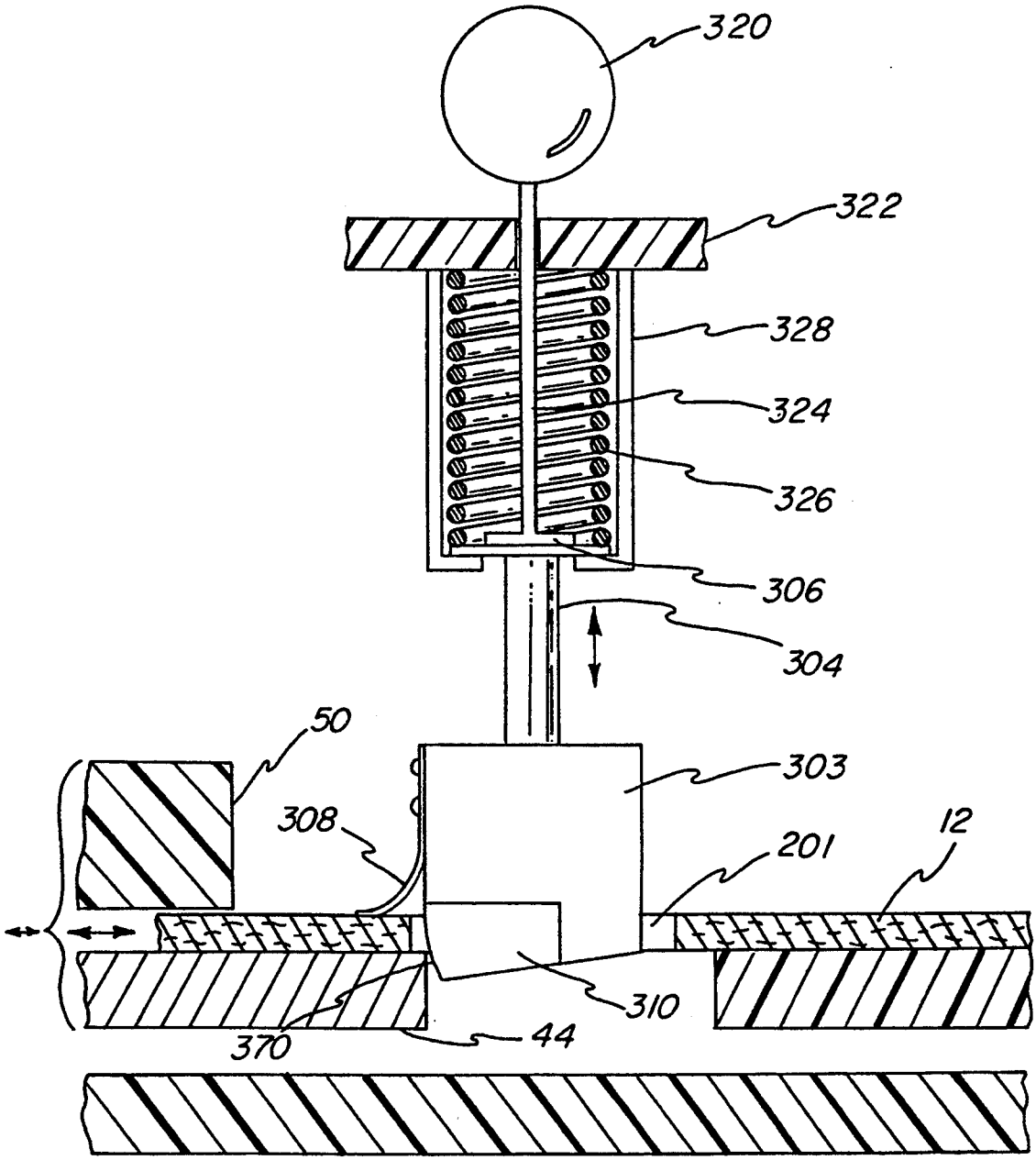
FIG. 6 is an illustration of the barricade of FIG. 3 in its fully activated position.

As illustrated in FIG. 6, flange 306 is captured inside a cylindrical housing 328. A compression spring 326 inside housing 328 bears against flange 306, forcing block 302 in the downward direction. Housing 328 is fixed to a bracket 322, which in turn is secured to base 14 of vote recorder 10. An actuator 320 has a plunger 324 which reaches through bracket 322 and into housing 328. The lower end of plunger 324 is secured to flange 306. This enables a voter to raise barricade 300, against the opposing force of spring 326 by pulling upwardly on actuator 320.

In the illustration of FIG. 6 barricade 300 is in the "voting" position, and the openings in ballot holder 18 are in alignment with access apertures 58 of mask plate 23. In that position barricade block 302 bears against the head end of punch plate 44, thereby resisting the force of leaf spring 66 and reducing the compressive stresses on ballot card 12.

Figure 5:
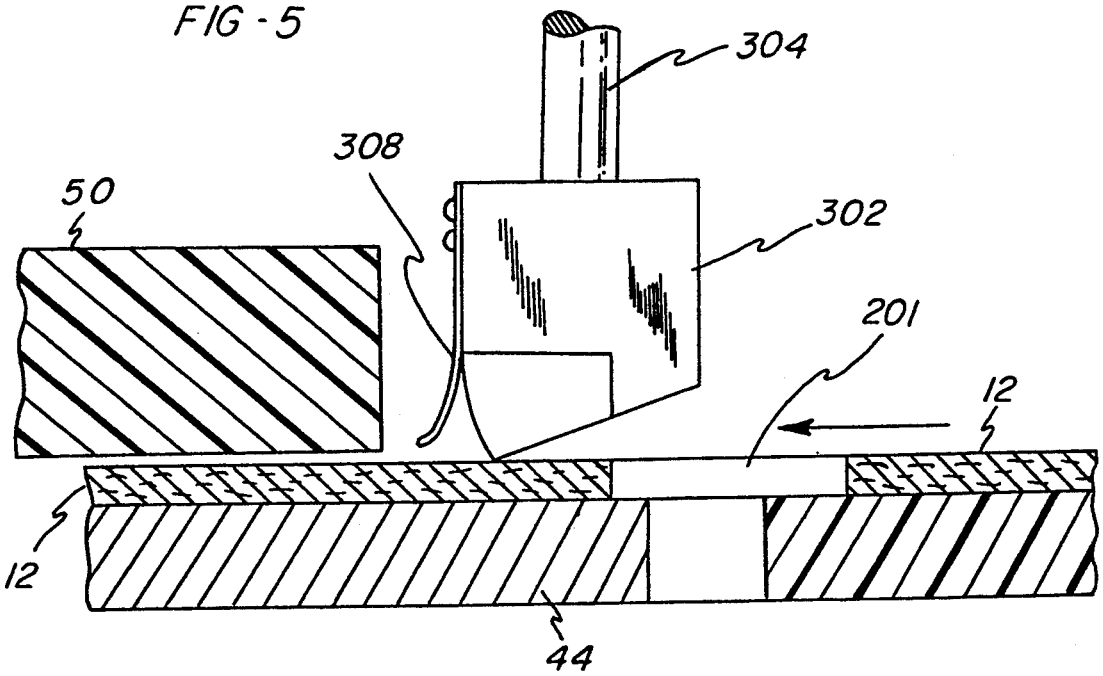

When ballot holder 18 is in the lockout position, barricade block 302 bears downwardly against the extending upper surface of punch plate 44, as illustrated in FIG. 14. The lower surface of barricade block 302 is upwardly sloped, as indicated by the reference numeral 351, for engagement by the foot of a ballot card 12. When a ballot card 12 is inserted into vote recorder 10, it engages the surface 351 and raises barricade block 302 slightly for sliding passage thereunder. FIG. 5 illustrates barricade block 302 in its slightly raised position.

Ballot card 12 is provided with a triangular opening 201 (FIG. 7) for receiving barricade block 302. After ballot card 12 has been fully inserted and has contacted card block 52, guide plate 50 begins its above-described forward movement against the resistance of leaf spring 66. As the forward movement progresses, the opening 201 comes into alignment with barricade block 302. At this point the spring 326 forces barricade block 302 downwardly into the position illustrated in FIGS. 6 and 7. Barricade block 302 has a slightly curved leading edge 370 for smoothing out the descent.

Once barricade 300 has dropped into its lowered position, reverse movement of ballot holder 18 is prevented, and the voter may release the ballot card. It will be appreciated that as soon as barricade 300 begins restraining reverse movement of ballot holder 18, the compressive force of leaf spring no longer acts upon ballot card 12. However it is still necessary to place some small forwardly acting force upon the ballot card to insure registration against card block 52. This force is provided by the skirt 308. As barricade block 302 drops into position, skirt 308 contacts the upper surface of ballot card 12 and flexes upwardly and forwardly. The high friction lower surface of skirt engages ballot card 12 and pushes it forwardly against card block 52 with a slight force, just sufficient to produce the desired registration.

The rearwardly angled waist section 310 of barricade block 302 cooperates with the triangular opening 201 in ballot card 12 to produce left and right centering of the ballot card, as best illustrated in FIG. 7. One of the side walls of the ballot card passage preferably has a slight taper (not illustrated) for centering of the foot of the ballot card. This is complemented at the head of the ballot card by the movement of barricade block 302 into the opening 201. When voting has been completed the voter pulls upwardly on the actuator 320 until barricade block 302 clears the opening 201 in ballot card 12. Leaf spring 66 then pushes ballot card 12 rearwardly out of vote recorder 10. It will be appreciated, however, that the illustration of actuator 320 is merely exemplary and that a wide variety of actuators or toggle devices could be used for producing the desired vertical movement of barricade 300.

Figure 8:
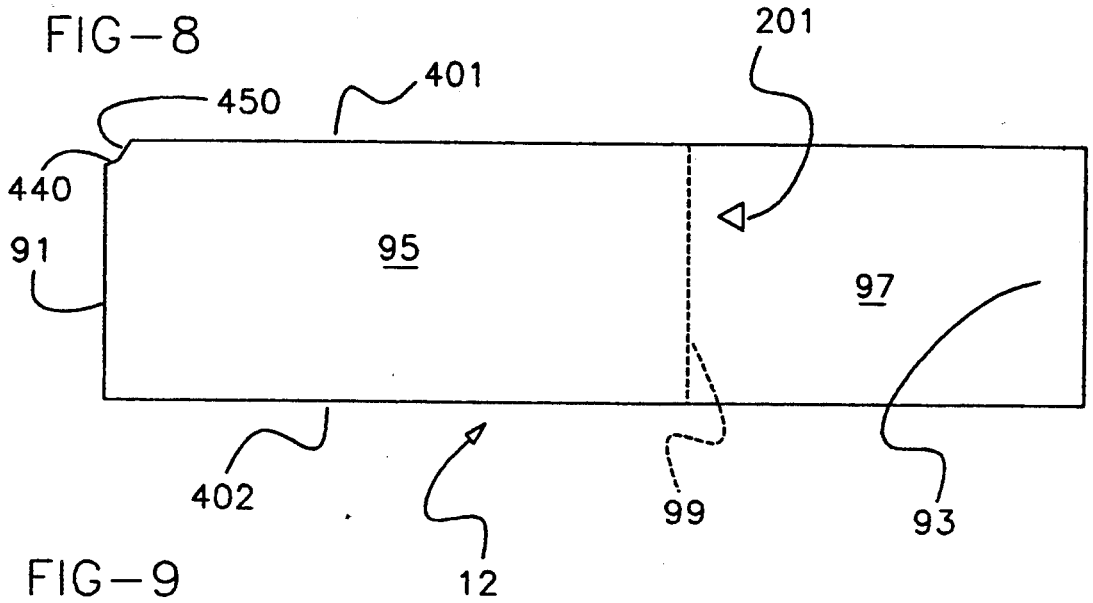
FIG. 8 is a top plan view of the ballot card of this invention.

The ballot card of this invention is illustrated in FIG. 8 and comprises a voting portion 95 separated from a detachable record portion 97 by a perforation line 99. Voting portion 95 terminates at a foot 91 which bears against registration surface 99 of card block 52 when the ballot card is in use. Record portion 97 has a head 93 which is remote from perforation line 99. First and second side edges 401 and 402 respectively extend from head 93 to foot 91.

Voting portion 92 has a cutout at the corner between first side edge 401 and foot 91. This cutout is defined by tapered edges 440 and 450. The edge 440 cooperates with the inwardly tapered side wall of the ballot card passage to achieve the above-mentioned side-to-side registration of the foot of the ballot card. The edge 450 provides a recess for convenient placement of the edge 440. Edge 450 has an angle approximating the corner cut of conventional data processing cards. Edge 440 preferably meets foot 91 at an angle between about 105 deg. and 135 deg.

Triangular opening 201 is die-cut into record portion 97 in an off-center location, as illustrated in FIG. 8. This makes it necessary to insert the ballot card into the vote recorder in a right-side-up orientation in order to lock it into position.

Figure 9:
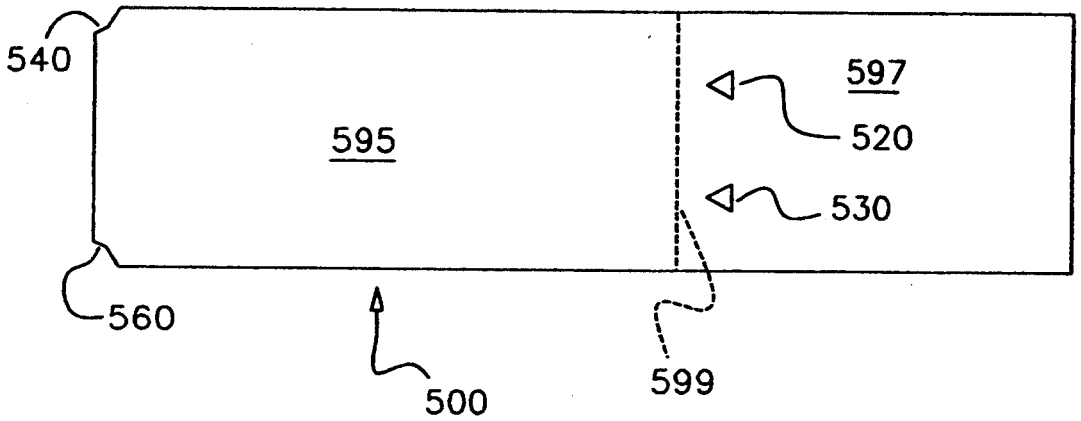
FIG. 9 is a top plan view of the ballot card in an alternative embodiment.

FIG. 9 illustrates a ballot card 500 in an alternative embodiment. Ballot card 500 has a record portion 597 and a voting portion 595 detachably joined along a perforation line 599. This particular embodiment is intended for two-sided use. When using ballot card 500, a voter inserts it, front side up, into the vote recorder, votes one side, removes the ballot card from the vote recorder, turns it over, and then reinserts it for rear side voting. Ballot card 500 is provided with a pair of triangular openings 520, 530 to enable locking engagement in either orientation by an off-center barricade. It also has a pair of recessed and tapered edges 540, 560 for centering of the foot of the ballot card.

While the forms of product herein described constitute a preferred embodiments of this invention, it is to be understood that the invention is not limited to these precise forms of product, and that changes may be made therein without departing from the scope of the invention which is defined in the appended claims.

What is claimed is:

1. A non-scored ballot card of generally rectangular configuration comprising:

a first side edge defining a side boundary for said ballot card.

a second side edge opposite said first side edge and defining a second side boundary for said ballot card, a foot in the form an end edge extending sidewardly between said first side edge and said second side edge for positional registration of said ballot card inside a vote recorder, a voting portion situated between said first side edge and said second side edge and adjacent said foot, and a record portion adjoining said voting portion opposite said foot and provided with a triangular opening having a vertex which points toward said foot.

2. A non-scored ballot card according to claim 1, said voting portion being provided with a cutout between said first side edge and said foot, said cutout defining a recessed and tapered edge for side-to-side registration of said foot.

3. A non-scored ballot card according to claim 2, said opening being positioned at an off-center location for preventing locking engagement of said opening when said ballot card is inserted into a vote recorder in an inverted orientation.

4. A non-scored ballot according to claim 3 and further comprising a perforated line for separating said record portion from said voting portion.

5. A non-scored ballot card according to claim 4 wherein said recessed and tapered edge meets said foot at an angle between about 105 deg. and 135 deg.

6. A non-scored ballot card of generally rectangular configuration comprising:

a first side edge defining a side boundary for said ballot card a second side edge opposite said first side edge and defining a second side boundary for said ballot card, a foot in the form an end edge extending sidewardly between said first side edge and said second side edge for positional registration of said ballot card inside a vote recorder, a voting portion situated between said first side edge and said second side edge and adjacent said foot, and a record portion adjoining said voting portion opposite said foot, said record portion being provided with a pair of side-by-side triangular openings having vertices which point toward said foot.

* * * * *